US008516833B2

(12) United States Patent
Xu et al.

(10) Patent No.: US 8,516,833 B2
(45) Date of Patent: Aug. 27, 2013

(54) 4-VALVE PULSE TUBE CRYOCOOLER

(75) Inventors: Mingyao Xu, Nishitokyo (JP); Hirokazu Takayama, Nishitokyo (JP); Kyosuke Nakano, Nishitokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 443 days.

(21) Appl. No.: 12/824,271

(22) Filed: Jun. 28, 2010

(65) Prior Publication Data

US 2011/0000226 A1 Jan. 6, 2011

(30) Foreign Application Priority Data

Jul. 3, 2009 (JP) ..... 2009-159019

(51) Int. Cl.
*F25B 9/00* (2006.01)

(52) U.S. Cl.
USPC ..... 62/6

(58) Field of Classification Search
USPC ..... 62/6
See application file for complete search history.

(56) References Cited

U.S. PATENT DOCUMENTS

| | | | | |
|---|---|---|---|---|
| 5,974,807 | A * | 11/1999 | Gao et al. | 62/6 |
| 6,256,998 | B1 * | 7/2001 | Gao | 62/6 |
| 6,751,985 | B2 * | 6/2004 | Kimble et al. | 62/613 |
| 7,549,295 | B2 * | 6/2009 | Gao | 62/6 |

FOREIGN PATENT DOCUMENTS

| | | |
|---|---|---|
| JP | 2000-018742 | 1/2000 |
| JP | 2008-224142 | 9/2008 |

* cited by examiner

*Primary Examiner* — Frantz Jules
*Assistant Examiner* — Brian King
(74) *Attorney, Agent, or Firm* — IPUSA, PLLC

(57) ABSTRACT

A 4-valve pulse tube cryocooler has, on a high-pressure end of a compressor, first and second coolant supply channels respectively connected to high-temperature ends of a regenerator and a pulse tube. The cryocooler further has, on a low-pressure end of the compressor, a first coolant recovery channel connected to the high-temperature end of the regenerator, a second coolant recovery channel connected to the high-temperature end of the pulse tube, and a third coolant recovery channel connected to the high-temperature end of the pulse tube via a common pipe and including a flow resistance member interposed between a flow control valve and the high-temperature end of the pulse tube.

11 Claims, 9 Drawing Sheets

4-VALVE PULSE TUBE CRYOCOOLER

CROSS-REFERENCE TO RELATED APPLICATIONS

This application is based upon and claims the benefit of priority of the prior Japanese Patent Application No. 2009-159019, filed on Jul. 3, 2009, the entire contents of which are incorporated herein by reference.

BACKGROUND OF THE INVENTION

1. Field of the Invention

The present invention generally relates to pulse tube cryocoolers, and more particularly to a 4-valve pulse tube cryocooler.

2. Description of the Related Art

Conventionally, a pulse tube cryocooler is used to cool an apparatus that requires a cryogenic (or very low temperature) environment, such as a Magnetic Resonance Imaging (MRI) system.

The pulse tube cryocooler repeats an operation of flowing a coolant gas (for example, helium gas) that has been compressed by a compressor to a regenerator and a pulse tube, as a working fluid, and an operation of recovering the working fluid from the pulse tube and the regenerator to the compressor, in order to form a cryogenic state at lower-temperature ends of the regenerator and the pulse tube. In addition, it is possible to absorb heat from a cooling target by thermally contacting the cooling target to the low-temperature ends of the regenerator and the pulse tube.

A 4-valve pulse tube cryocooler has a high cooling efficiency, and there are high expectations to apply the 4-valve pulse tube cryocooler in various fields.

FIG. 1 is a diagram illustrating a general structure of an example of a conventional single-stage 4-valve pulse tube cryocooler, such as that proposed in a Japanese Laid-Open Patent Publication No. 2000-18742, for example. A single-stage 4-valve pulse tube cryocooler 10 illustrated in FIG. 1 includes a compressor 12, a regenerator 40 having a high-temperature end 42 and a low-temperature end 44, and a pulse tube 50 having a high-temperature end 52 and a low-temperature end 54. The low-temperature end 44 of the regenerator 40 and the low-temperature end 54 of the pulse tube 50 are connected via a pipe 56.

Each of a high-pressure (or supply) end and a low-pressure (or recovery) end of a coolant channel of the compressor 12 branches into two channels. One channel branching from the high-pressure end of the coolant channel of the compressor 12 is connected to the high-temperature end 42 of the regenerator 40 via a first high-pressure pipe 15A having a on-off valve V1 provided thereon and a common pipe 20. In addition, the other channel branching from the high-pressure end of the coolant channel of the compressor 12 is connected to the high-temperature end 52 of the pulse tube 50 via a second high-pressure pipe 25A having a on-off valve V2 provided thereon and a common pipe 30.

Similarly, one channel branching from the low-pressure end of the coolant channel of the compressor 12 is connected to the high-temperature end 42 of the regenerator 40 via a first low-pressure pipe 15B having a on-off valve V3 provided thereon and the common pipe 20. In addition, the other channel branching from the low-pressure end of the coolant channel of the compressor 12 is connected to the high-temperature end 52 of the pulse tube 50 via a second low-pressure pipe 25B having a on-off valve V4 provided thereon and the common pipe 30. A flow control valve 60, such as an orifice, is connected to the common pipe 30.

According to the 4-valve pulse tube cryocooler having the structure described above, when the on-off valve V2 is opened in a process of supplying a high-pressure coolant gas, the coolant gas enters the pulse tube 50 via the second high-pressure pipe 25A and the common pipe 30. In addition, when the on-off valve V1 is opened, the coolant gas from the compressor 12 passes through the first high-pressure pipe 15A and the common pipe 20, and enters the regenerator 40 and further reaches the pulse tube 50. On the other hand, when the on-off valve V4 is opened in a process of recovering a low-pressure coolant gas, the coolant gas from the high-temperature end 52 of the pulse tube 50 passes through the common pipe 30 and the second low-pressure pipe 25B, and is recovered by the compressor 12. Further, when the on-off valve V3 is opened, the coolant gas from the low-temperature end 54 of the pulse tube 50 passes through the pipe 56 and the regenerator 40, and is recovered by the compressor 12 via the common pipe 20 and the first low-pressure pipe 15B.

However, during operation of the 4-valve pulse tube cryocooler 10, there is a problem in that a secondary flow of the coolant gas occurs to circulate in a closed loop indicated by an arrow L in FIG. 1, due to an unbalance of the coolant gas flows between the coolant gas supply process and the coolant gas recovery process. For example, the closed loop includes the on-off valve V2, the flow control valve 60, the pulse tube 50, the pipe 56, the regenerator 40, the common pipe 20, and the on-off valve V1. The secondary flow of the coolant gas is unidirectional and causes heat loss. For this reason, the cooling efficiency of the pulse tube cryocooler 10 greatly deteriorates when the secondary flow occurs.

The main cause of the secondary flow is a resistance, formed by the flow control valve 60, with respect to a bidirectional flow of the coolant gas, that causes the unbalance of the high-pressure coolant gas flow during the coolant gas supply process and low-pressure coolant gas flow during the coolant gas recovery process. For example, the amount of high-pressure coolant gas flowing downwards through the flow control valve 60 in FIG. 1 during the coolant gas supply process may be large compared to the amount of low-pressure coolant gas flowing upwards through the flow control valve 60 in FIG. 1. In such a case, the unbalance between the amounts of coolant gas flowing below and above the flow control valve 60 in FIG. 1 easily generates the secondary flow indicated by the arrow L.

FIG. 2 is a diagram illustrating a general structure of another example of the conventional single-stage 4-valve pulse tube cryocooler that has been proposed to suppress the secondary flow described above. In FIG. 2, those parts that are the same as those corresponding parts in FIG. 1 are designated by the same reference numerals, and a description thereof will be omitted.

Compared to the pulse tube cryocooler 10 illustrated in FIG. 1, a single-stage 4-valve pulse tube cryocooler 10' illustrated in FIG. 2 does not have a flow control valve 60 in the common pipe 30. Instead, the pulse tube cryocooler 10' has first and second flow control valves 60*a* and 60*b*. The first flow control valve 60*a* is provided on the second high-pressure pipe 25A, on a downstream side (that is, lower side in FIG. 2) of the on-off valve V2. The second flow control valve 60*b* is provided on the second low-pressure pipe 25B on an upstream side (that is, lower side in FIG. 2) of the on-off valve V4.

In the coolant gas supply process, a portion of the coolant gas from the compressor 12 flows to the pulse tube 50 via the second high-pressure pipe 25A in which the first flow control valve 60*a* is provided and the common pipe 30. On the other hand, in the coolant gas recovery process, a portion of the coolant gas from the pulse tube 50 flows to the compressor 12 via the common pipe 30 and the second low-pressure, pipe 25B in which the second flow control valve 325B is provided. Hence, by appropriately controlling the first and second flow control valves 60*a* and 60*b*, it becomes possible to independently control the amount of high-pressure coolant gas from the high-temperature end 52 of the pulse tube 50 to the pulse tube 50 and the amount of low-pressure coolant gas exhausted from the high-temperature end 52 of the pulse tube 50. Accordingly, the structure of the pulse tube cryocooler 10' may suppress the secondary flow circulating in the closed loop described above.

SUMMARY OF THE INVENTION

According to one aspect of the present invention, there is provided a 4-valve pulse tube cryocooler including a regenerator including a high-temperature end and a low-temperature end; a pulse tube including a high-temperature end and a low temperature end connected to the low-temperature end of the regenerator; a compressor including a high-pressure end and a low-pressure end; a first coolant supply channel, including a first high-pressure pipe that includes a first on-off valve provided thereon, and connected to the high-pressure end of the compressor and the high-temperature end of the regenerator; a second coolant supply channel, connected to the high-pressure end of the compressor, including a second high-pressure pipe that includes a second on-off valve provided thereon, and a common pipe including a flow control valve provided thereon and connected to the high-temperature end of the pulse tube; a first coolant recovery channel including a first low-pressure pipe that includes a third on-off valve provided thereon, and connected to the low-pressure end of the compressor and the high-temperature end of the regenerator; a second coolant recovery channel, connected to the low-pressure end of the compressor, including a second low-pressure pipe that includes a fourth on-off valve provided thereon, and the common pipe including the flow control valve provided thereon and connected to the high-temperature end of the pulse tube; and a third coolant recovery channel connected to the low-pressure end of the compressor and to the high-temperature end of the pulse tube via the common pipe, wherein the third coolant recovery channel includes a flow resistance member interposed between the flow control valve and the high-temperature end of the pulse tube.

Other objects and further features of the present invention will be apparent from the following detailed description when read in conjunction with the accompanying drawings.

DETAILED DESCRIPTION

The following problems occur in the pulse tube cryocooler 10' having the structure described above in conjunction with FIG. 2.

Figure 1:
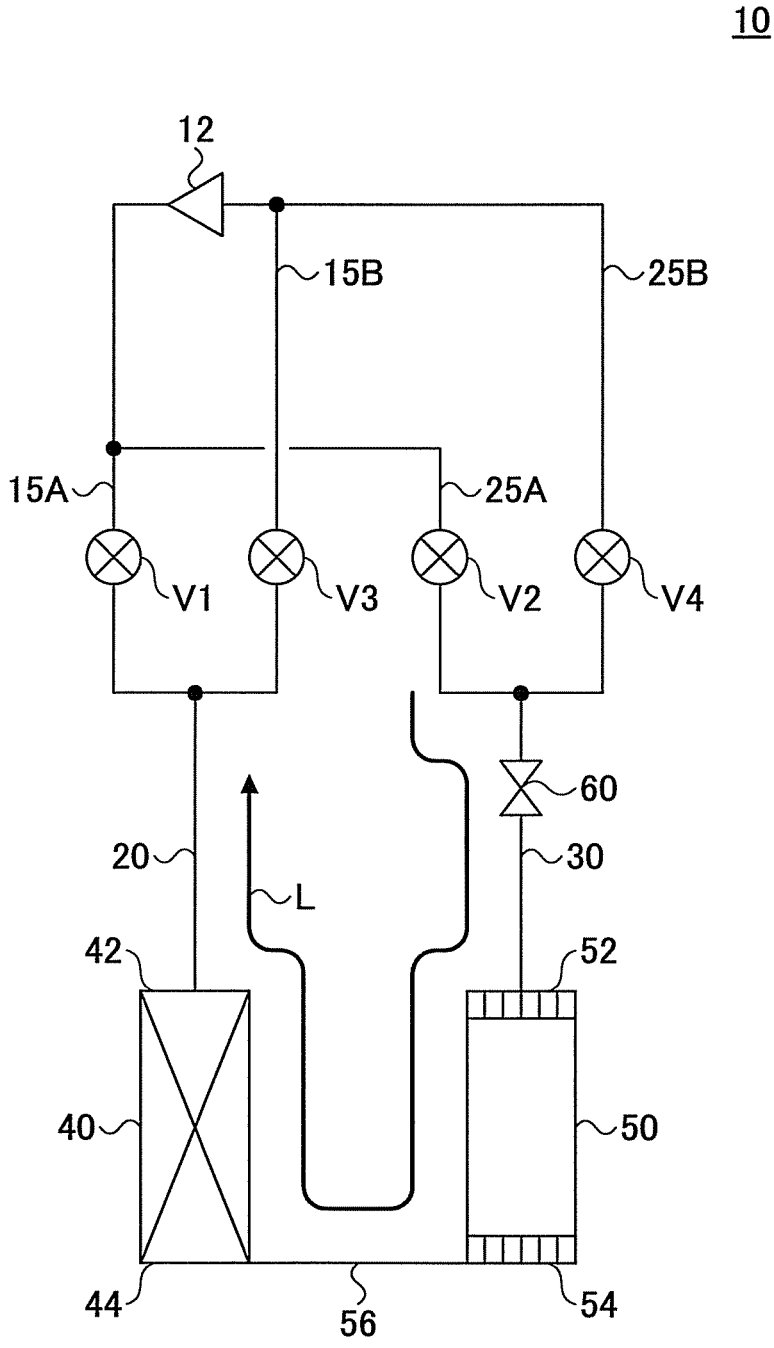
FIG.1 RELATED ART
FIG. 1 is a diagram illustrating a general structure of an example of a conventional single-stage 4-valve pulse tube cryocooler.

That is, in general, when the cryocooler is put into operation for a long period of time, frictional wear of the on-off valve V2 occurs due to the flow of the high-pressure coolant gas, and valve dust (or powder) is generated by the frictional wear. Because the coolant gas flow in the flow control valve 60 is bidirectional in the pulse tube cryocooler 10 illustrated in FIG. 1 described above, the valve dust is unlikely to accumulate in the flow control valve 60.

Figure 2:
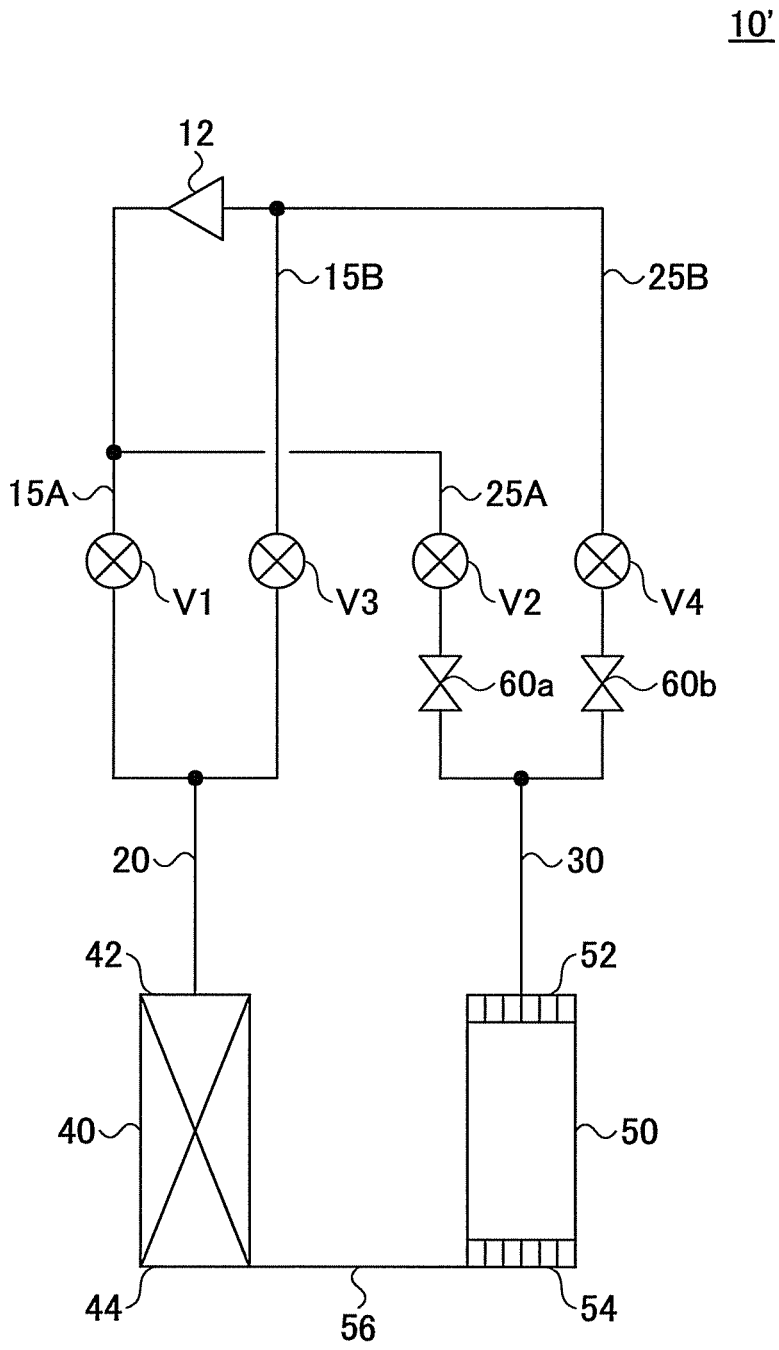
FIG.2 RELATED ART
FIG. 2 is a diagram illustrating a general structure of another example of the conventional single-stage 4-valve pulse tube cryocooler.

On the other hand, in the pulse tube cryocooler 10' illustrated in FIG. 2, the coolant gas flow is unidirectional (that is, downward direction in FIG. 2) in the first flow control valve 60*a*. In this case, the valve dust generated by the frictional wear of the on-off valve V2 reaches the first flow control valve 60*a* together with the coolant gas, and thereafter remains within the first flow control valve 60*a*. In addition, when the mixing and accumulation of the valve powder become notable, a channel area of the first flow control valve 60*a* varies, to thereby deteriorate the precision of the first flow control valve 60*a*. The deterioration in the precision of the first flow control valve 60*a* causes the cooling efficiency of the pulse tube cryocooler 10' to deteriorate, and it may become difficult to obtain an appropriate cooling performance by the pulse tube cryocooler 10'.

Accordingly, it is a general object of one aspect of the present invention to provide a novel and useful 4-valve pulse tube cryocooler in which the problems described above are suppressed.

Another and more specific object of one aspect of the present invention is to provide a 4-valve pulse tube cryocooler that may suppress generation of a secondary flow of coolant gas and to maintain an appropriate cooling performance of the pulse tube cryocooler for a long period of time.

A description will now be given of embodiments of the pulse tube cryocooler according to the present invention, by referring to FIGS. 3 through 9.

Figure 3:
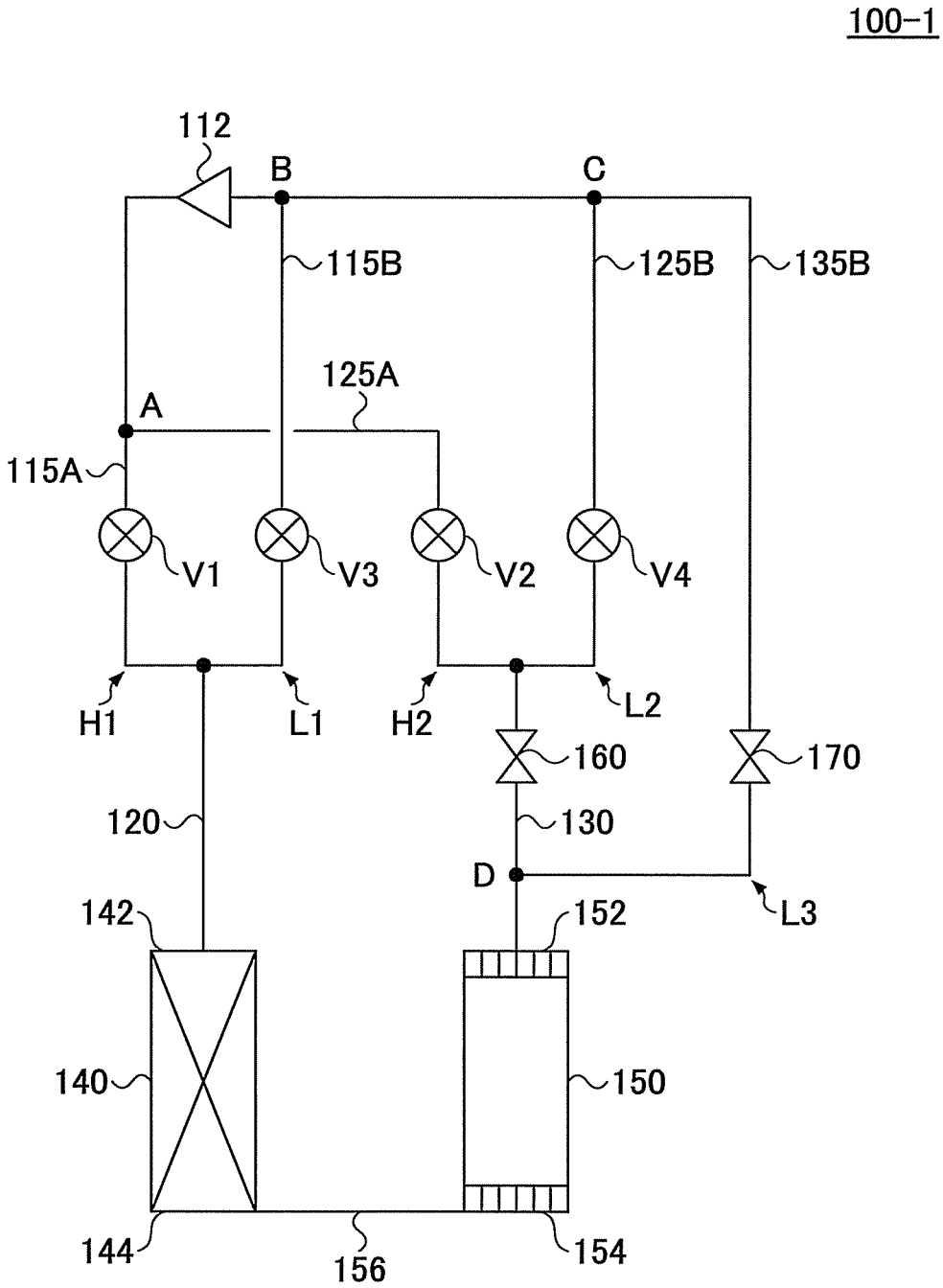
FIG. 3 is a diagram illustrating a general structure of an example of a 4-valve pulse tube cryocooler in a first embodiment of the present invention.

FIG. 3 is a diagram illustrating a general structure of an example of a 4-valve pulse tube cryocooler in a first embodiment of the present invention. As illustrated in FIG. 3, a 4-valve pulse tube cryocooler 100-1 of this first embodiment includes a compressor 112, a regenerator 140, a pulse tube 150, and pipes associated therewith.

The regenerator 140 includes a high-temperature end 142 and a low-temperature end 144. The pulse tube 150 has a high-temperature end 152 and a low-temperature end 154. A heat exchanger is provided in the high-temperature end 152 and the low-temperature end 154 of the pulse tube 150. The low-temperature end 144 of the regenerator 140 and the low-temperature end 154 of the pulse tube 150 are connected by a pipe 156.

A coolant channel on a high-pressure end (or outlet end) of the compressor 112 branches into 2 directions at a point A, namely, a first high-pressure pipe 115A and a second high-pressure pipe 125A. Hence, a high-pressure coolant gas supplied from the compressor 112 is supplied to the high-temperature end 142 of the regenerator 140 via a first coolant supply channel H1 that is formed by the first high-pressure pipe 115A, provided with a on-off valve V1 thereon, and a common pipe 120. In addition, a portion of the high-pressure coolant gas supplied from the compressor 112 is supplied to the heat exchanger at the high-temperature end 152 of the pulse tube 150 via a second coolant supply channel H2 that is formed by the second high-pressure pipe 125A, provided with a on-off valve V2 thereon, and a common pipe 130. A flow control valve 160 is provided on the common pipe 130.

On the other hand, a coolant channel on a low-pressure end (or inlet end) of the compressor 112 branches into 3 directions, namely, first, second and third coolant recovery channels L1, L2 and L3. The first coolant recovery channel L1 is formed by a channel from the regenerator 140 to the compressor 112, via the common pipe 120, the first low-pressure pipe 115B provided with a on-off valve V3 thereon, and a point B. The second coolant recovery channel L2 is formed by a channel from the pulse tube 150 to the compressor 112, via the common pipe 130, the second low-pressure pipe 125B provided with a on-off valve V4 thereon, a point C, and the point B. The third coolant recovery channel L3 is formed by a channel from the pulse tube 150 to the compressor 112, via a branching pipe 135B that branches at a point D of the common pipe 130, the point C, and the point B. A flow control valve 170, such as an orifice, is provided on the branching pipe 135B.

Figure 4:
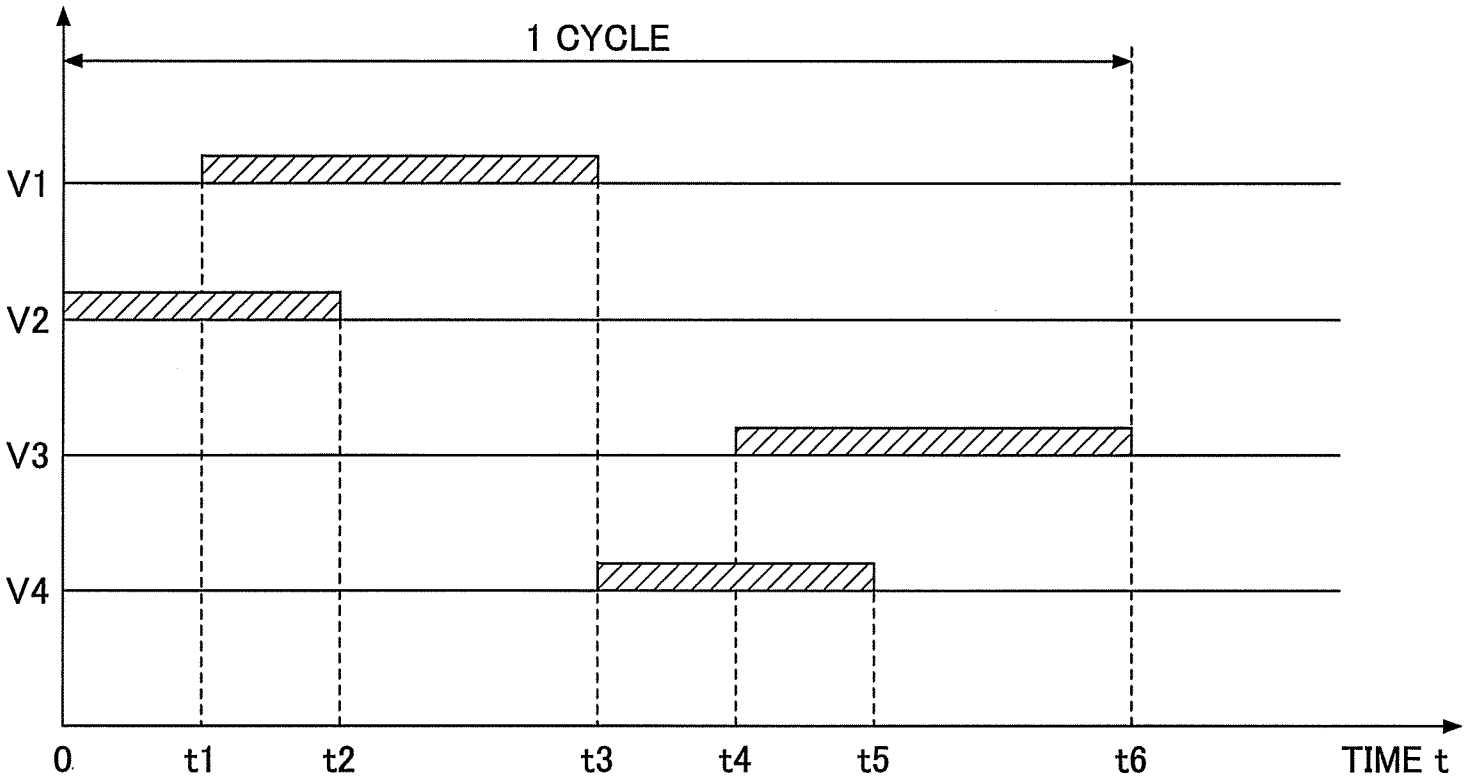
FIG. 4 is a timing diagram for explaining open and closed states of 4 valves during operation of the pulse tube cryocooler illustrated in FIG. 3.

Next, a description will be given of an operation of the 4-valve pulse tube cryocooler 100-1 illustrated in FIG. 3, by referring to FIG. 4. FIG. 4 is a timing diagram for explaining open and closed states of 4 on-off valves V1 through V4 during operation of the pulse tube cryocooler 100-1 illustrated in FIG. 3.

During operation of the pulse tube cryocooler 100-1, open and closed states of the 4 on-off valves V1 through V4 change periodically in response to driving by driving sources, such as valve motors. FIG. 4 time-sequentially illustrates the open and closed states of the 4 on-off valves V1 through V4 during operation of the pulse tube cryocooler 100-1.

[First Process Stage: Times 0 to t1]

First, at a time t=0, only the on-off valve V2 is opened. As a result, the high-pressure coolant gas from the compressor 112 is supplied to the pulse tube 150 via the second coolant supply channel H2.

[Second Process Stage: Times t1 to t2]

Next, at a time t=t1, the on-off valve V1 is opened in the state where the on-off valve V2 is maintained open. As a result, the high-pressure coolant gas from the compressor 112 is supplied to the regenerator 140 via the first coolant supply channel H1. The coolant gas supplied to the regenerator 140 is cooled by a regenerative material provided within the regenerator 140. The cooled coolant gas enters the pulse tube 150 via the pipe 156, and is subjected to a heat exchange in the heat exchanger provided at the low-temperature end 154 of the pulse tube 150.

[Third Process Stage: Times t2 to t3]

Next, at a time t=t2, the on-off valve V2 is closed in a state where the on-off valve V1 is maintained open. Hence, the coolant gas cooled by the regenerator 140 continues to enter the pulse tube 150 from the low-temperature end 154 via the pipe 156. However, the supply of coolant gas from the second coolant supply channel H2 to the high-temperature end 152 of the pulse tube 150 is stopped in this case, and the coolant gas cooled by the regenerator 140 moves in a direction in which the pulse tube 150 extends, from the low-temperature end 154 to the high-temperature end 152 of the pulse tube 150. Accordingly, the coolant gas is subjected to a heat exchange in both the heat exchanger provided at the high-temperature end 152 of the pulse tube 150 and the heat exchanger provided at the low-temperature end 154 of the pulse tube 150.

Moreover, a portion of the coolant gas accommodated in advance in the high-temperature end 152 of the pulse tube 150 is exhausted via the third coolant recovery channel L3, to thereby return to the compressor 112. Furthermore, a portion of the coolant gas is accommodated within a reservoir (not illustrated) that is connected to the high-temperature end 152 of the pulse tube 150.

The pulse tube 150, and particularly the low-temperature end 154, is cooled by the operation described above.

[Fourth Process Stage: Times t3 to t4]

Next, at a time t=t3, the on-off valve V1 is closed, and the on-off valve V4 is opened. As a result, the coolant gas within the pulse tube 150 returns to the compressor 112 via the third coolant recovery channel L3 and the coolant recovery channel L2.

[Fifth Process Stage: Times t4 to t5]

At a time t=t4, the on-off valve V3 is opened in a state where the on-off valve V4 is maintained open. As a result, the coolant gas within the pulse tube 150 returns to the compressor 112 via not only the second and third coolant recovery channels L2 and L3, but also the first coolant recovery channel L1 from the low-temperature end 154 of the pulse tube 150 via the pipe 156 and the regenerator 140. A cryogenic state occurs within the pulse tube 150 due to expansion of the coolant gas. In addition, the regenerative material within the regenerator 140 is cooled by the coolant gas entering the regenerator 140 from the pulse tube 150.

[Sixth Process Stage: Times t5 to t6]

Next, at a time t=t5, the on-off valve V4 is closed in a state where the on-off valve V3 is maintained open. As a result, the second coolant recovery channel L2 is blocked. The coolant gas within the pulse tube 150 returns to the compressor 112 from the low-temperature end 154 of the pulse tube 150 via the pipe 156, the regenerator 140, and the first coolant recovery channel L1. Moreover, a portion of the coolant gas within the pulse tube 150 returns to the compressor 112 from the high-temperature end 152 of the pulse tube 150 via the third coolant recovery channel L3. Hence, the regenerative material within the regenerator 140 is further cooled.

The first through sixth process stages of the process are regarded as 1 cycle, and such cycles are repeated in order to cool a cooling target (not illustrated in FIG. 3) that is provided at the low-temperature end 154 of the pulse tube 150.

As described above, in the pulse tube cryocooler 10' illustrated in FIG. 2, the valve dust generated by the frictional wear of the on-off valve V2 reaches the first flow control valve 60*a* together with the coolant gas, and thereafter remains within the first flow control valve 60*a*. In addition, when the mixing and accumulation of the valve powder become notable, a channel area of the first flow control valve 60*a* varies, to thereby deteriorate the precision of the first flow control valve 60*a*.

On the other hand, in the pulse tube cryocooler 100-1 of this embodiment, the coolant gas flows downwards through the flow control valve 160 in FIG. 3 from the first process stage to the second process stage. In addition, the coolant gas flows upwards through the flow control valve 160 in FIG. 3 from the fourth process stage to the fifth process stage. In other words, the coolant gas flows upwards and downwards, that is, in 2 directions, through the flow control valve 160 during one cycle. For this reason, it is possible to significantly reduce accumulation of the valve dust generated by the frictional wear of the on-off valve V2 within the flow control valve 160. Accordingly, in the pulse tube cryocooler 100-1 of this embodiment, the flow control valve 160 may operate for a long period of time without deteriorating the precision thereof. Thus, the pulse tube cryocooler 100-1 may maintain an appropriate cooling efficiency (or cooling capability) for a long period of time.

In addition, in the pulse tube cryocooler 100-1 of this embodiment, the second and third coolant recovery channels L2 and L3 are provided with the flow control valves 160 and 170, respectively. Hence, it is possible to balance the amount of coolant gas supplied from the second coolant supply channel H2 to the pulse tube 150 and the amount of coolant gas exhausted from the second and third coolant recovery channels L2 and L3, by adjusting the two flow control valves 160 and 170. Consequently, it is possible to significantly reduce the generation of a secondary flow of coolant gas, which may deteriorate the cooling performance and the cooling efficiency of the pulse tube cryocooler 100-1.

Second Embodiment

Figure 5:
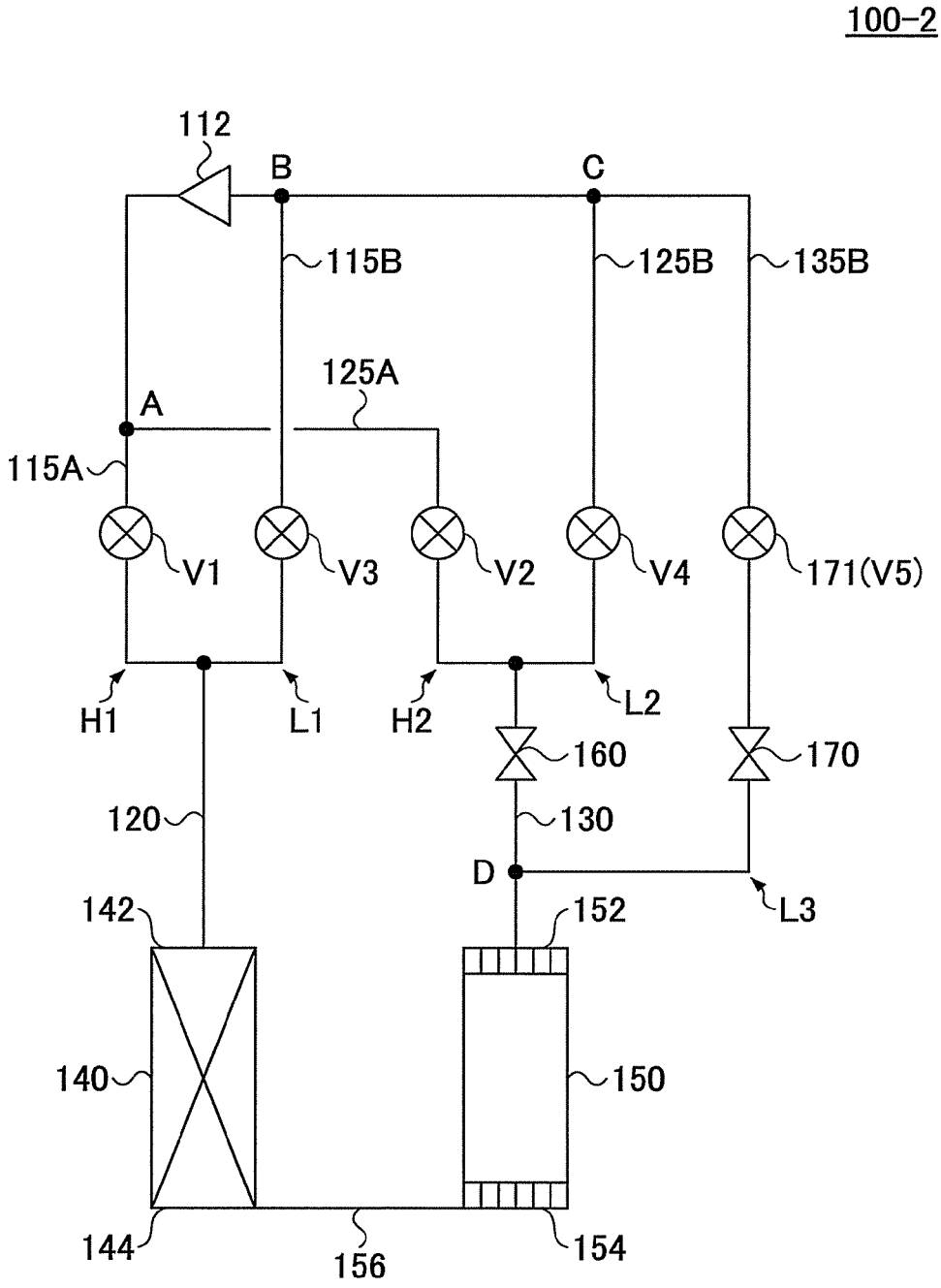
FIG. 5 is a diagram illustrating a general structure of an example of the 4-valve pulse tube cryocooler in a second embodiment of the present invention.

FIG. 5 is a diagram illustrating a general structure of an example of the 4-valve pulse tube cryocooler in a second embodiment of the present invention. In FIG. 5, those parts that are the same as those corresponding parts in FIG. 3 are designated by the same reference numerals, and a description thereof will be omitted.

A 4-valve pulse tube cryocooler 100-2 illustrated in FIG. 5 has a structure similar to that of the pulse tube cryocooler 100-1 illustrated in FIG. 3, but further includes a on-off valve 171 (or V5) provided in the third coolant recovery channel L3. The on-off valve 171 is located closer to the compressor 112 than the flow control valve 170. In other words, the on-off valve 171 is arranged on the downstream side of the low-pressure coolant gas flow relative to the flow control valve 170.

Figure 6:
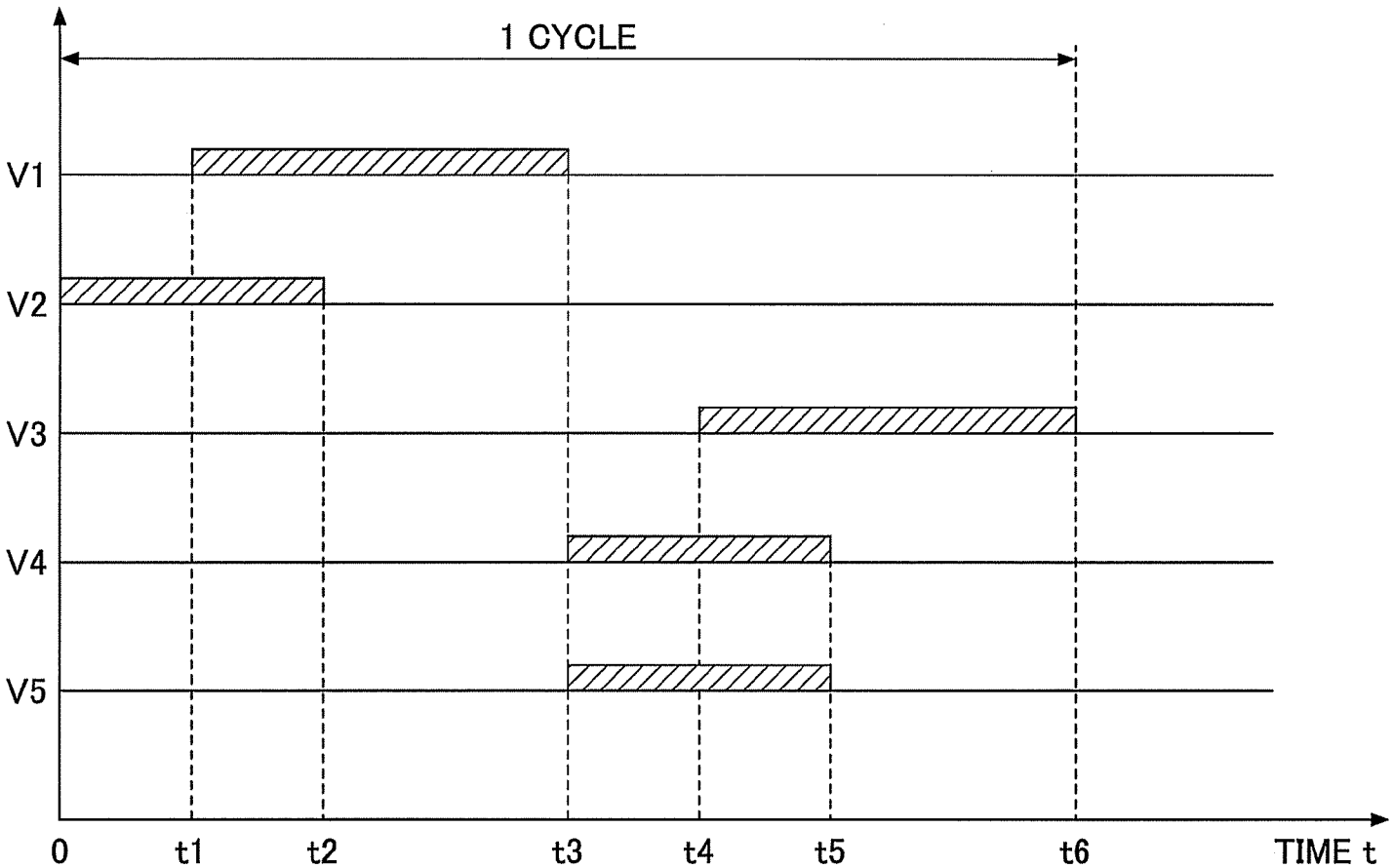
FIG. 6 is a timing diagram for explaining open and closed states of 5 valves during operation of the pulse tube cryocooler illustrated in FIG. 5.

FIG. 6 is a timing diagram for explaining open and closed states of 5 on-off valves V1 through V5 during operation of the pulse tube cryocooler 100-2 illustrated in FIG. 5. FIG. 6 time-sequentially illustrates the open and closed states of the 5 on-off valves V1 through V5 during operation of the pulse tube cryocooler 100-2.

The basic operation of the pulse tube cryocooler 100-2 is similar to that of the pulse tube cryocooler 100-1 described above. Hence, first through sixth process stages described above are regarded as one cycle, and such a cycle is repeated to cool the cooling target.

The timings at which the on-off valve 171 (or V5) is opened and closed are substantially the same as those of the on-off valve V4. In other words, the on-off valve 171 (or V5) is open in the fourth process stage (time t=t3 to t4) to the fifth process stage (time t=t4 to t5), together with the on-off valve V4.

In the first and second process stages, the coolant gas is supplied from the compressor 112 to the pulse tube 150 via the second coolant supply channel H2, and the common pipe 130 having the flow control valve 160 provided thereon. In addition, in the fourth and fifth process stages, the coolant gas from the pulse tube 150 is recovered by the compressor 112 via the common pipe 130 having the flow control valve 160 provided thereon, and the second coolant recovery channel L2, with a portion of the coolant gas also being recovered via the third coolant recovery channel L3.

Accordingly, the effects obtainable in the first embodiment are also obtainable in this second embodiment. In other words, it is possible to significantly reduce accumulation of the valve dust generated by the frictional wear of the on-off valve V2 within the flow control valve 160, and to significantly reduce the generation of a secondary flow of coolant gas. Furthermore, compared to the first embodiment, this second embodiment may more accurately control the coolant gas flowing through the third coolant recovery channel L3.

Third Embodiment

A 4-valve pulse tube cryocooler in a third embodiment of the present invention has a structure similar to that of the pulse tube cryocooler 100-2 illustrated in FIG. 5, except that the flow control valve 170 is omitted in this third embodiment.

According to the pulse tube cryocooler in this third embodiment, it is possible to appropriately control the open and closed states of the on-off valve 171 (or V5), to thereby control the amount coolant gas flowing through the third coolant recovery channel L3, and to reduce the generation of a secondary flow of coolant gas.

In order to obtain the effects described above by the 4-valve pulse tube cryocooler in the first through third embodiments described above, (1) measures are taken so that bi-directional flow of the coolant gas occurs in the flow control valve 160, and (2) a so-called "channel resistance member" capable of adjusting the flow of the low-pressure coolant gas is provided in the third coolant recovery channel L3. Accordingly, one aspect of the present invention includes any 4-valve pulse tube cryocooler having the features (1) and (2) described above. The flow resistance member may be the flow control valve 170 (or orifice) of the first embodiment or, the on-off valve 171 of the third embodiment. Alternatively, the flow resistance member may include a plurality of members, such as the valves 170 and 171, as in the case of the second embodiment.

Fourth Embodiment

Figure 7:
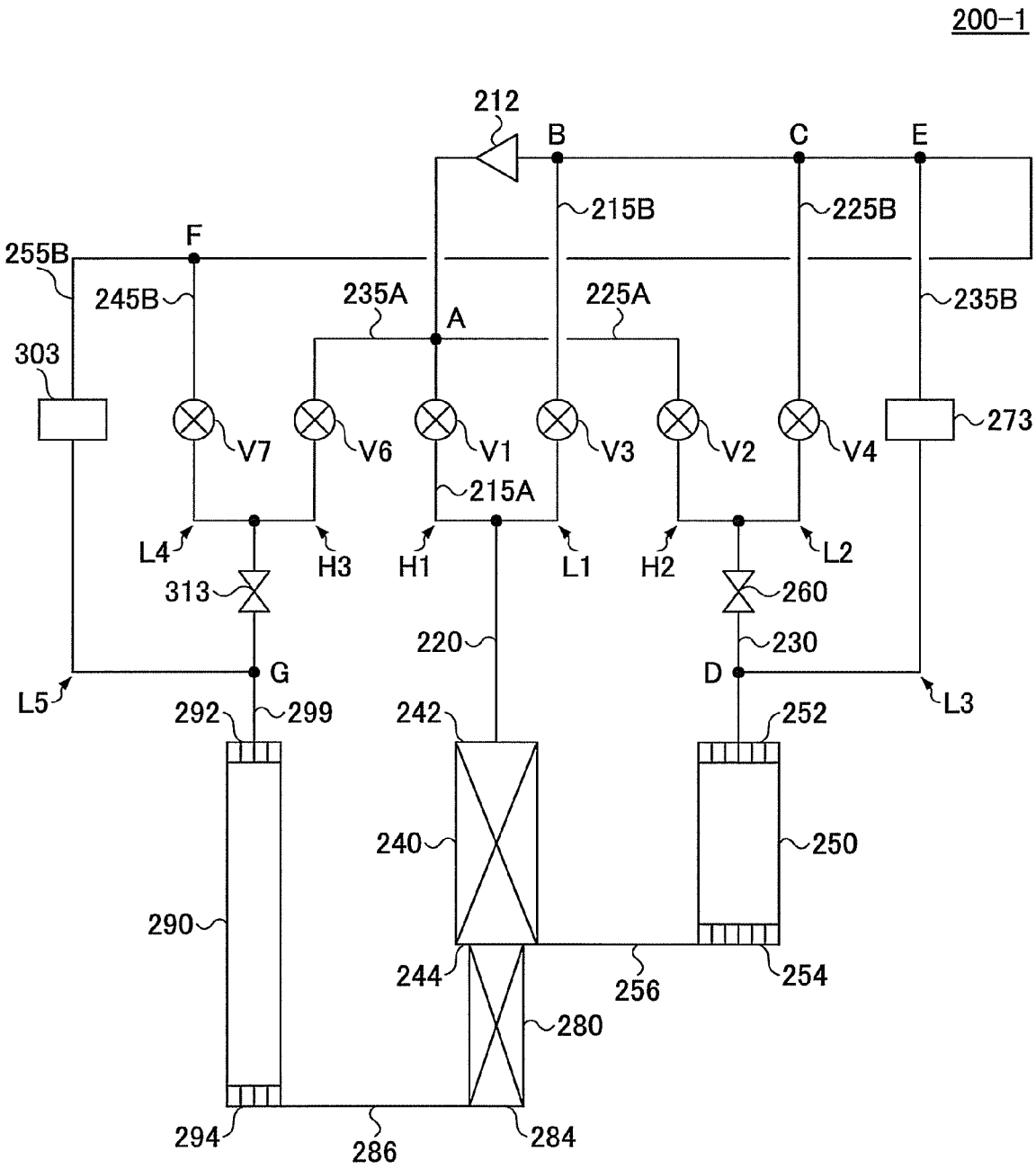
FIG. 7 is a diagram illustrating a general structure of an example of the 4-valve pulse tube cryocooler in a fourth embodiment of the present invention.

FIG. 7 is a diagram illustrating a general structure of an example of the 4-valve pulse tube cryocooler in a fourth embodiment of the present invention. In FIG. 7, those parts that are the same as those corresponding parts in FIG. 3 are designated by the same reference numerals, and a description thereof will be omitted.

A 4-valve pulse tube cryocooler 200-1 illustrated in FIG. 7 has a 2-stage structure. The pulse tube cryocooler 200-1 includes a compressor 212, regenerators 240 and 280 of first and second stages, pulse tubes 250 and 290 of the first and second stages, first and second pipes 256 and 286, first and second flow resistance members 273 and 303, on-off valves V1 through V4, V6 and V7, and the like.

The regenerator 240 of the first stage includes a high-temperature end 242 and a low-temperature end 244. The regenerator 280 of the second stage includes a high-temperature end 244 corresponding to the low-temperature end 244 of the first stage, and a low-temperature end 284. The pulse tube 250 of the first stage includes a high-temperature end 252 and a low-temperature end 254. The pulse tube 290 of the second stage includes a high-temperature end 252 and a low-temperature end 294. A heat exchanger is provided in each of the high-temperature ends 252 and 292 and the low-temperature ends 254 and 294 of the pulse tubes 250 and 290 of the first and second stages. The low-temperature end 244 of the regenerator 240 of the first stage is connected to the low-temperature end 254 of the pulse tube 250 of the first stage via the first pipe 256. In addition, the low-temperature end 284 of the regenerator 280 of the second stage is connected to the low-temperature end 294 of the pulse tube 290 of the second stage via the second pipe 286.

A coolant channel on a high-pressure end (or outlet end) of the compressor 212 branches into 3 directions at a point A to form first, second and third coolant supply channels H1, H2 and H3. The first coolant supply channel H1 is formed from the high-pressure end of the compressor 212 to the regenerator 240 of the first stage, via a first high-pressure pipe 215A having the on-off valve V1 provided thereon, and a common pipe 220. The second coolant supply channel H2 is formed from the high-pressure end of the compressor 212 to the pulse tube 250 of the first stage, via a second high-pressure pipe 225A having the on-off valve V2 provided thereon, and a common pipe 230 having a flow control valve 260 provided thereon. The third coolant supply channel H3 is formed from the high-pressure end of the compressor 212 to the pulse pipe 290 of the second stage, via a third high-pressure pipe 235A having the on-off valve V6 provided thereon, and a common pipe 299 having a flow control valve 313 provided thereon.

On the other hand, the low-pressure end (or inlet end) of the compressor 212 branches into 5 directions to first through fifth coolant recovery channels L1 through L5. The first coolant recovery channel L1 is formed from the regenerator 240 of the first stage to the compressor 212, via the common pipe 220, a first low-pressure pipe 215B having the on-off valve V3 provided thereon, and a point B. The second coolant recovery channel L2 is formed from the pulse tube 250 of the first stage to the compressor 212, via the common pipe 230 having the flow control valve 260 provided thereon, a second low-pressure pipe 225B having the on-off valve V4 provided thereon, a point C, and the point B. The third coolant recovery channel L3 is formed from the pulse tube 250 of the first stage to the compressor 212, via a third low-pressure pipe 235B that branches at a point D of the common pipe 230, a point E, the point C and the point B. A first flow resistance member 273 is provided on the third low-pressure pipe 235B. The fourth coolant recovery channel L4 is formed from the pulse tube 290 of the second stage to the compressor 212, via common pipe 299 having the flow control valve 313 provided thereon, a fourth low-pressure pipe 245B having the on-off valve V7 provided thereon a point F, the point E, the point C, and the point B. The fifth coolant recovery channel L5 is formed from the pulse tube 290 of the second stage to the compressor 212, via a branch pipe 255B that branches at a point G of the common pipe 299, a point F, the point E, the point C, and the point B.

Figure 8:
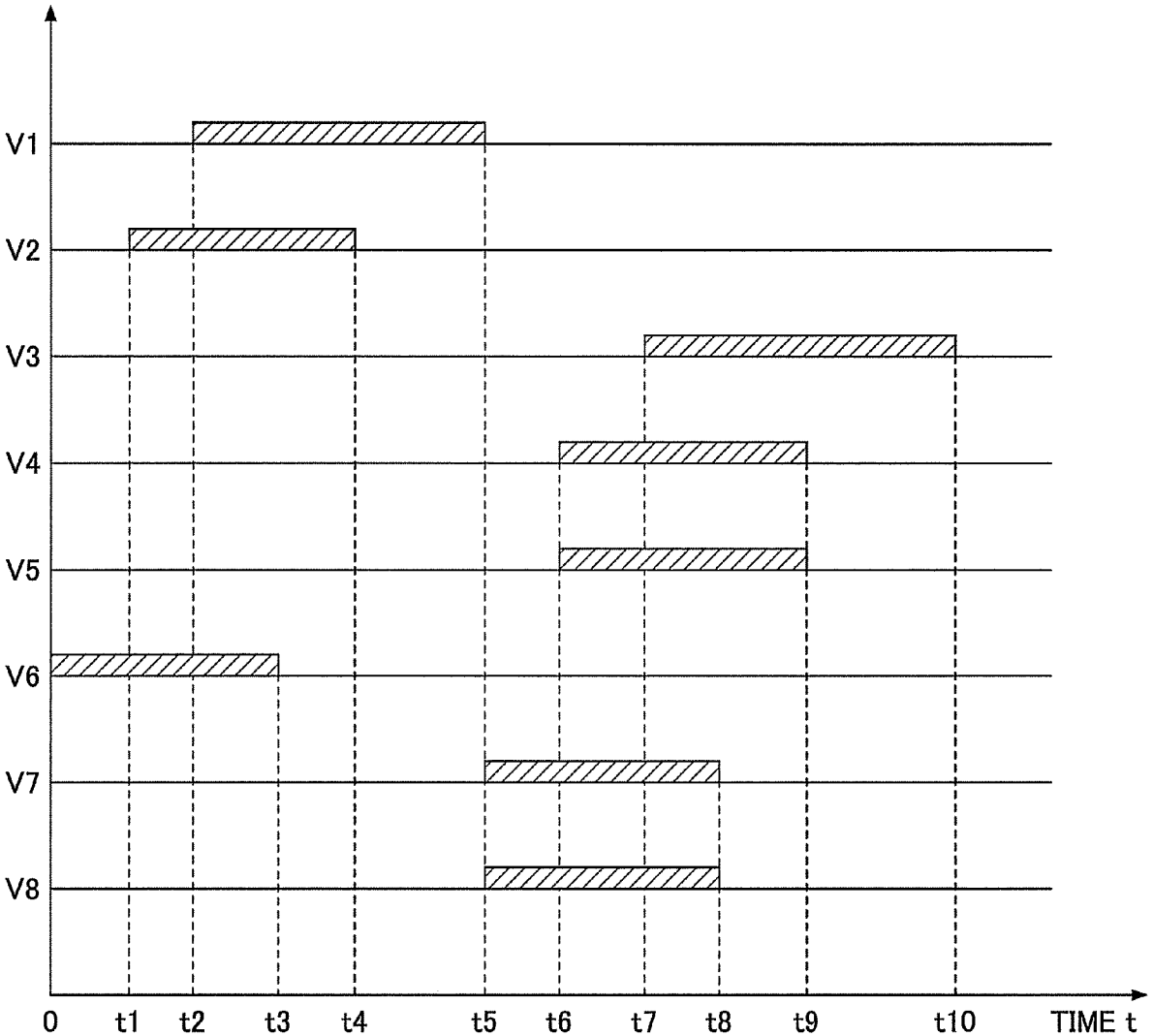
FIG. 8 is a timing diagram for explaining open and closed states of 8 valves during operation of the pulse tube cryocooler illustrated in FIG. 7.

Next, a description will be given of an operation of the 4-valve pulse tube cryocooler 200-1 illustrated in FIG. 7, by referring to FIG. 8. FIG. 8 is a timing diagram for explaining open and closed states of 8 on-off valves V1 through V8 during operation of the pulse tube cryocooler 200-1 illustrated in FIG. 8. It is assumed for the sake of convenience in the following description that the first flow resistance member 273 includes a on-off valve V5, and the second flow resistance member 303 includes a on-off valve V8.

FIG. 8 time-sequentially illustrates the open and closed states of the 8 on-off valves V1 through V8 during operation of the pulse tube cryocooler 200-1. During operation of the pulse tube cryocooler 200-1, open and closed states of the 8 on-off valves V1 through V8 change periodically in response to driving by driving sources, such as valve motors.

[First Process Stage: Time 0 to t2]

First, at a time t=0, only the on-off valve V6 is opened. As a result, the coolant gas is supplied from the compressor 212 to the pulse tube 290 of the second stage, via the third coolant supply channel H3 that includes the third high-pressure pipe 235A, the common pipe 299, and the high-temperature end 292 of the pulse tube 290 of the second stage. Thereafter, at a time t=t1, the on-off valve V2 is opened in a stage where the on-off valve V6 is maintained open. Hence, the coolant gas is supplied from the compressor 212 to the pulse tube 250 of the first stage, via the second coolant supply channel H2 that includes the second high-pressure pipe 225A, the common pipe 230, and the high-temperature end 252 of the pulse tube 250.

[Second Process Stage: Time t2 to t3]

Next, at a time t=t2, the on-off valve V1 is opened in a state where the on-off valves V6 and V2 are maintained open. As a result, the coolant gas from the compressor 212 is introduced into the regenerator 240 of the first stage, via the first coolant supply channel H1 that includes the first high-pressure pipe 215A, the common pipe 220, and the high-temperature end 242 of the regenerator 240. A portion of the coolant gas flows from the low-temperature end 254 of the pulse tube 250 to the pulse tube 250 of the first stage, via the first pipe 256. In addition, another portion of the coolant gas passes through the regenerator 280 of the second stage, and flows into the pulse tube 290 of the second stage from the low-temperature end 294 thereof, via the second pipe 286.

[Third Process Stage: Time t3 to t5]

Next, at a time t=t3, the on-off valve 6 is closed in a stage where the on-off valve V1 is maintained open, and the on-off valve V2 is closed thereafter at a time t=t4. The coolant gas from the compressor 212 is introduced into the regenerator 240 of the first stage, only via the first coolant supply channel H1, and thereafter flows into the pulse tubes 250 and 290 from the low-temperature ends 254 and 294 thereof.

[Fourth Process Stage: Time t=t5]

At a time t=t5, all of the on-off valves V1 through V6 are closed. Because of the pressure rise within the pulse pipes 250 and 290 of the first and second stages, respectively, the coolant gas within the pulse tubes 250 and 290 of the first and second stages move towards a reservoir (not illustrated) that is provided on the high-temperature ends 252 and 292 of the pulse tubes 250 and 290.

[Fifth Process Stage: Time t5 to t7]

Thereafter, at a time t=t5, the on-off valves V7 and V8 are opened. As a result, the coolant gas within the pulse tube 290 of the second stage returns to the compressor 212 via the fourth coolant recovery channel L4 and the fifth coolant recovery channel L5. Then, at a time t=t6, the on-off valves V4 and V5 are opened. Thus, the coolant gas within the pulse tube 250 of the first stage returns to the compressor 212 via the second coolant recovery channel L2 and the third coolant recovery channel L3. Consequently, the pressure within the pulse tubes 250 and 290 decreases.

[Sixth Process Stage: Time t7 to t8]

Next, at a time t=t7, the on-off valve V3 is opened in a stage where the on-off valves V7, V8, V4 and V5 are maintained open. As a result, a large portion of the coolant gas within the pulse tubes 250 and 290 and the regenerator 280 of the second stage passes through the regenerator 240 of the first stage, and returns to the compressor 212 via the first coolant recovery channel L1.

[Seventh Process Stage: Time t8 to t10]

Next, at a time t=t8, the on-off valves V7 and V8 are closed in a stage where the on-off valve V3 is maintained open, and the on-off valves V4 and V5 are thereafter closed at a time t=t9. Then, at a time t=t10, the on-off valve V3 is closed, to thereby complete one cycle.

In the pulse tube cryocooler 200-1, the coolant gas flows downwards in FIG. 7 through the flow control valve 260 during the first, second and third process stages from the time t1 to t4. On the other hand, the coolant gas flows upwards in FIG. 7 through the flow control valve 260 during the fifth, sixth and seventh process stages from the time t6 to t9. Furthermore, the coolant gas flows downwards in FIG. 7 through the flow control valve 313 during the first and second process stages from the time 0 to t3, and the coolant gas flows upwards in FIG. 7 through the flow control valve 313 during the fifth and sixth process stages from the time t5 to t8.

In other words, the coolant gas flows upwards and downwards in 2 directions through each of the flow control valves 260 and 313 during one cycle. For this reason, according to the pulse tube cryocooler 200-1, it is possible to significantly reduce accumulation of the valve dust generated by the frictional wear of the on-off valves V2 and V6 within the flow control valves 260 and 313. Hence, the pulse tube cryocooler 200-1 may maintain an appropriate cooling efficiency (or cooling capability) for a long period of time.

In addition, in the pulse tube cryocooler 200-1, the high-pressure coolant gas supply channel H2 to the high-temperature end 252 of the pulse tube 250 of the first stage is separated from the low-pressure coolant gas recovery channel L2 from the high-temperature end 252 of the pulse tube 250 of the first stage. Moreover, the high-pressure coolant gas supply channel H3 to the high-temperature end 292 of the pulse tube 290 of the second stage is separated from the low-pressure coolant gas recovery channel L4 from the high-temperature end 292 of the pulse tube 290 of the second stage. For this reason, it is possible to significantly reduce the generation of a secondary flow of coolant gas, which may deteriorate the cooling performance and the cooling efficiency of the pulse tube cryocooler 200-1.

Fifth Embodiment

Figure 9:
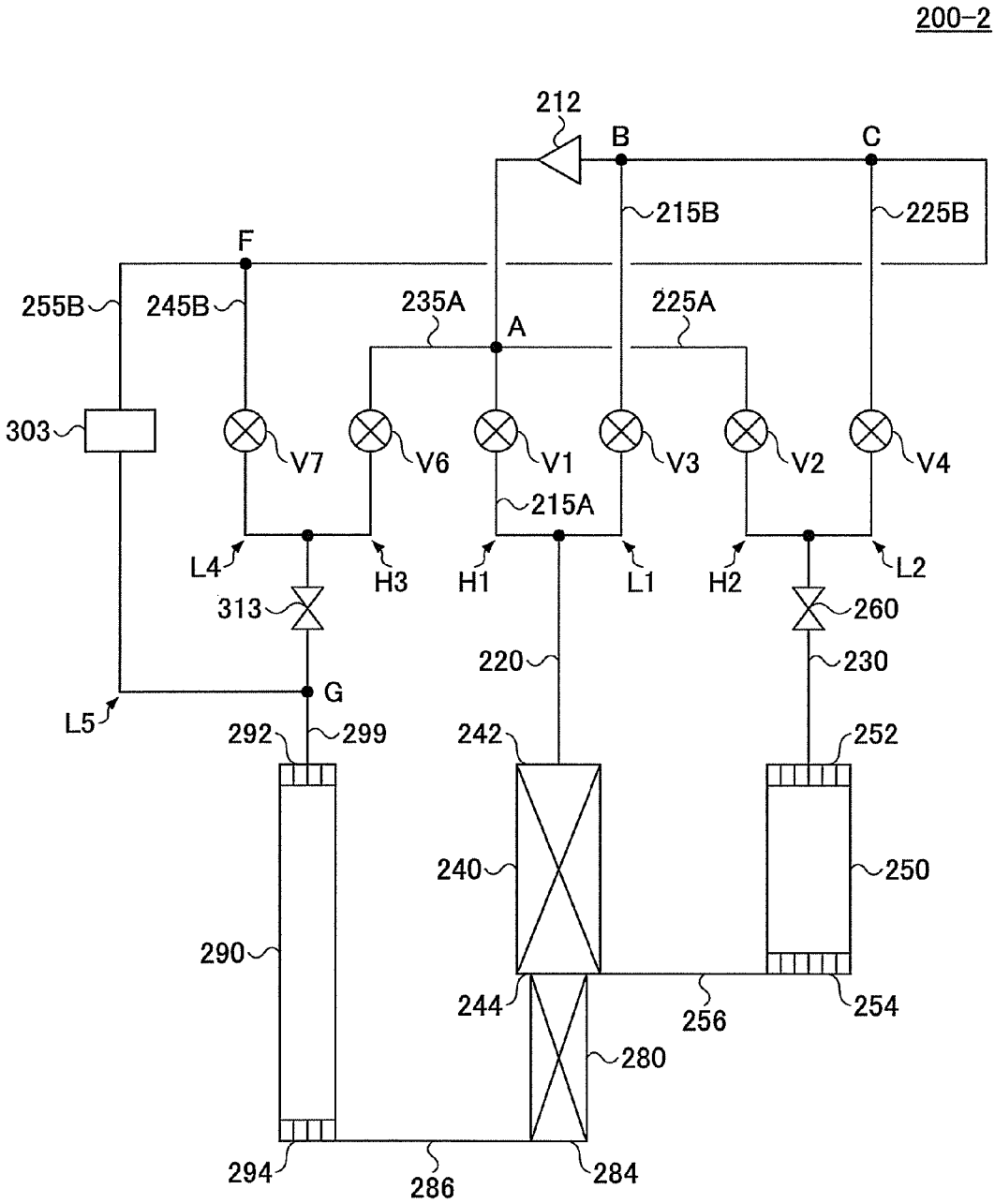
FIG. 9 is a diagram illustrating a general structure of an example of the 4-valve pulse tube cryocooler in a fifth embodiment of the present invention.

FIG. 9 is a diagram illustrating a general structure of an example of the 4-valve pulse tube cryocooler in a fifth embodiment of the present invention. In FIG. 9, those parts that are the same as those corresponding parts in FIG. 7 are designated by the same reference numerals, and a description thereof will be omitted.

A 4-valve pulse tube cryocooler 200-2 illustrated in FIG. 9 has a structure similar to that of the pulse tube cryocooler 200-1 illustrated in FIG. 7. However, the third coolant recovery channel L3 illustrated in FIG. 7 is omitted in the pulse tube cryocooler 200-2. In other words, in the pulse tube cryocooler 200-2, the coolant channel on the low-pressure end (or inlet end) of the compressor 212 branches into 4 directions, namely, the first and second coolant recovery channels L1 and L2 and the fourth and fifth coolant recovery channels L4 and L5.

The timings at which the on-off valves V1 through V4 and V6 through V8 are opened and closed during operation of the pulse tube cryocooler 200-2 correspond to the timings illustrated in FIG. 8 excluding the opening and closing timings of the on-off valve V5 which is not provided in this fifth embodiment. Accordingly, a description and illustration of the process stages of this fifth embodiment will be omitted.

According to the pulse tube cryocooler 200-2 illustrated in FIG. 9, it is possible to significantly reduce accumulation of the valve dust generated by the frictional wear of the on-off valve V6 within the flow control valve 313. Hence, the pulse tube cryocooler 200-2 may maintain an appropriate cooling efficiency (or cooling capability) for a long period of time.

In addition, in the pulse tube cryocooler 200-2, it is possible to significantly reduce the generation of a secondary flow of coolant gas in a channel between the common pipe 299 having the flow control valve 313 provided thereon and the common pipe 220, via the pulse tube 290 of the second stage, the second pipe 286, the regenerator 280 of the second stage, and the regenerator 240 of the first stage, which secondary flow may deteriorate the cooling performance and the cooling efficiency of the pulse tube cryocooler 200-2.

Of course, the structure of the pulse tube cryocooler is not limited to those of the embodiments described above. For example, the fifth coolant recovery channel L5 may be omitted in the pulse tube cryocooler 200-1 illustrated in FIG. 7. Even with the fifth coolant recovery channel L5 omitted, it is possible to significantly reduce the generation of a secondary flow of coolant gas in a channel between the common pipe 220 and the common pipe 230 having the flow control valve 260 provided thereon, via the regenerator 240 of the first stage, the first pipe 256, and the pulse tube 250 of the first stage, which secondary flow may deteriorate the cooling performance and the cooling efficiency of the pulse tube cryocooler 200-2. It is also possible to significantly reduce accumulation of the valve dust generated by the frictional wear of the on-off valve V2 within the flow control valve 260. Therefore, it is possible to obtain the effects of preventing the cooling performance and the cooling efficiency of the pulse tube cryocooler from deteriorating due to the secondary flow, and to maintain an appropriate cooling efficiency (or cooling capability) for a long period of time.

In each of the embodiments described above, the high-temperature end of the pulse tube in the first stage and/or the second stage may be connected to a reservoir via a suitable pipe. This suitable pipe may include a flow resistance member formed by any one of an orifice, a flow control valve, and a on-off valve.

The timings at which the on-off valves V6 and V2 are opened in FIG. 8 may be approximately the same. In addition, the timings at which the on-off valve V7 (and V8) and the on-off valve V4 (and V5) are opened may be approximately the same. The timings at which the on-off valves V6 and V2 are closed may be approximately the same. The timings at which the on-off valve V7 (and V8) and the on-off valve V4 (and V5) are closed may be approximately the same.

Further, the present invention is not limited to these embodiments, but various variations and modifications may be made without departing from the scope of the present invention.

What is claimed is:

1. A 4-valve pulse tube cryocooler comprising:

a first regenerator including a high-temperature end and a low-temperature end;

a first pulse tube including a high-temperature end and a low temperature end connected to the low-temperature end of the first regenerator;

a compressor including a high-pressure end and a low-pressure end;

a first coolant supply channel, including a first high-pressure pipe that includes a first on-off valve provided thereon, and connected to the high-pressure end of the compressor and the high-temperature end of the first regenerator;

a second coolant supply channel, connected to the high-pressure end of the compressor, including a second high-pressure pipe that includes a second on-off valve provided thereon, and a first common pipe that includes a first flow control valve provided thereon and connected to the high-temperature end of the first pulse tube;

a first coolant recovery channel including a first low-pressure pipe that includes a third on-off valve provided thereon, and connected to the low-pressure end of the compressor and the high-temperature end of the first regenerator;

a second coolant recovery channel, connected to the low-pressure end of the compressor, including a second low-pressure pipe that includes a fourth on-off valve provided thereon, and the first common pipe that includes the first flow control valve provided thereon and connected to the high-temperature end of the first pulse tube; and a third coolant recovery channel including a first end connected directly to the low-pressure end of the compressor, a second end opposite to the first end and connected to the high-temperature end of the first pulse tube via the first common pipe, and a first flow resistance member interposed between the first and second ends of the third coolant recovery channel wherein the first end of the third coolant recovery channel is connected to the low-pressure end of the compressor without passing through the third and fourth on-off valves.

2. The 4-valve pulse tube cryocooler as claimed in claim 1, wherein the first flow resistance member includes one of a flow control valve and an on-off valve.

3. The 4-valve pulse tube cryocooler as claimed in claim 1, wherein the first flow resistance member includes a fifth on-off valve that is opened and closed with a timing approximately matching a timing at which the fourth on-off valve is opened and closed.

4. The 4-valve pulse tube cryo cooler as claimed in claim 1, further comprising:

a first stage and a second stage forming a 2-stage pulse tube cryocooler, wherein the first regenerator and the first pulse tube are provided in the first stage, and the second end of the third coolant recovery channel is connected between the first flow control valve and the high-temperature end of the first pulse tube via the first common pipe.

5. The 4-valve pulse tube cryocooler as claimed in claim 1, further comprising:

a first stage and a second stage forming a 2-stage pulse tube cryocooler, a second regenerator, provided in the second stage, including a high-temperature end and a low-temperature end; and a second pulse tube, provided in the second stage, including a high-temperature end and a low-temperature end, wherein the second coolant supply channel and the first common pipe of the second coolant recovery channel are connected to the high-temperature end of the first pulse tube, and the third coolant recovery channel is connected between the first flow control valve and the high-temperature end of the first pulse tube via the first common pipe.

6. The 4-valve pulse tube cryocooler as claimed in claim 1, further comprising:

a first stage and a second stage forming a 2-stage pulse tube cryocooler, a second regenerator, provided in the second stage, including a high-temperature end and a low-temperature end;

a second pulse tube, provided in the second stage, including a high-temperature end and a low-temperature end;

a third coolant supply channel, connected to the high-pressure end of the compressor, including a third high-pressure pipe including a sixth on-off valve provided thereon, and a second common pipe including a second flow control valve provided thereon and connected to the high-temperature end of the second pulse tube;

a fourth coolant recovery channel, connected to the low-pressure end of the compressor, including a fourth low-pressure pipe including a seventh on-off valve provided thereon, and the second common pipe including the second flow control valve provided thereon and connected to the high-temperature end of the second pulse tube; and a fifth coolant recovery channel connected to the low-pressure end of the compressor and to the high-temperature end of the second pulse tube via the second common pipe, wherein the fifth coolant recovery channel includes a second flow resistance member interposed between the second flow control valve and the high-temperature end of the second pulse tube.

7. The 4-valve pulse tube cryocooler as claimed in claim 6, wherein the second flow resistance member includes one of a flow control valve and an on-off valve.

8. The 4-valve pulse tube cryocooler as claimed in claim 6, wherein the second flow resistance member includes an eighth on-off valve that is opened and closed with a timing approximately matching a timing at which the seventh on-off valve is opened and closed.

9. The 4-valve pulse tube cryocooler as claimed in claim 1, wherein the first coolant supply channel is connected to the high-temperature end of the first regenerator, the first coolant recovery channel is connected to the high-temperature end of the first regenerator, the second coolant supply channel and the first common pipe of the second coolant recovery channel are connected to the high-temperature end of the first pulse tube, and the third coolant recovery channel is connected between the first flow control valve and the high-temperature end of the first pulse tube, via the first common pipe.

10. The 4-valve pulse tube cryocooler as claimed in claim 1, further comprising:

a first stage and a second stage forming a 2-stage pulse tube cryocooler, a second regenerator, provided in the second stage, including a high-temperature end and a low-temperature end; and a second pulse tube, provided in the second stage, including a high-temperature end and a low-temperature end, wherein the first regenerator and the first pulse tube are provided in the first stage, the first coolant supply channel is connected to the high-temperature end of the first regenerator, the first coolant recovery channel is connected to the high-temperature end of the first regenerator, the second coolant supply channel and the first common pipe of the second coolant recovery channel are connected to the high-temperature end of the second pulse tube, the third coolant recovery channel is connected between the first flow control valve and the high-temperature end of the first pulse tube, via the first common pipe, and the low-temperature end of the first pulse tube is connected to the low-temperature end of the first regenerator and the high-temperature end of the second regenerator via a first pipe.

11. The 4-valve pulse tube cryocooler as claimed in claim 10, wherein the low-temperature end of the second regenerator is connected to the low-temperature end of the second pulse tube via a second pipe.

* * * * *